US009520081B2

(12) United States Patent
Ryu

(10) Patent No.: US 9,520,081 B2
(45) Date of Patent: Dec. 13, 2016

(54) RECORDING DEVICE AND RECORDING METHOD USING THE SAME

(71) Applicant: SAMSUNG DISPLAY CO., LTD., Yongin, Gyeonggi-Do (KR)

(72) Inventor: Isamu Ryu, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 78 days.

(21) Appl. No.: 14/535,661

(22) Filed: Nov. 7, 2014

(65) Prior Publication Data

US 2015/0130858 A1 May 14, 2015

(30) Foreign Application Priority Data

Nov. 8, 2013 (JP) ..... 2013-231699

(51) Int. Cl.
*G09G 3/3208* (2016.01)
*G09G 3/32* (2016.01)

(52) U.S. Cl.
CPC ..... *G09G 3/3216* (2013.01); *G09G 3/3208* (2013.01); *G09G 2320/046* (2013.01); *G09G 2320/048* (2013.01); *G09G 2350/00* (2013.01)

(58) Field of Classification Search
None
See application file for complete search history.

(56) References Cited

U.S. PATENT DOCUMENTS

| | | | | |
|---|---|---|---|---|
| 8,054,252 | B2 | 11/2011 | Tada et al. | |
| 2005/0052369 | A1* | 3/2005 | Tada | G09G 3/3241 345/76 |
| 2009/0016627 | A1 | 1/2009 | Uetani et al. | |
| 2012/0162280 | A1* | 6/2012 | Yamashita | G09G 3/3258 345/690 |
| 2012/0162285 | A1* | 6/2012 | Yamashita | G09G 3/32 345/690 |
| 2015/0279324 | A1* | 10/2015 | Ohta | G09G 3/3283 345/690 |

FOREIGN PATENT DOCUMENTS

| | | | |
|---|---|---|---|
| EP | 1 310 939 | B1 | 4/2013 |
| JP | 10-051768 | A | 2/1998 |
| JP | 2005-275180 | A | 10/2005 |
| JP | 2009-206737 | A | 9/2009 |
| JP | 2009-251024 | A | 10/2009 |

* cited by examiner

*Primary Examiner* — Seokyun Moon
(74) *Attorney, Agent, or Firm* — Lee & Morse P.C.

(57) ABSTRACT

A device is provided that includes a subtraction portion that outputs a difference value between a target totalizing value, obtained by accumulating a luminance value of a target pixel up to a current frame, and a reference totalizing value corresponding to a luminance value of a reference pixel, adjacent the target pixel, accumulated up to the current frame; a quantization portion that quantizes the difference value and outputs a quantization value; and a quantization error correction portion that corrects the quantization value at a correction frame selected based on a quantization step of the quantization value and a quantization error of the quantization value.

13 Claims, 9 Drawing Sheets

FIG. 6

| t | g | h | i | j | Second Delay Portion |
|---|---|---|---|---|---|
| 0 | $L_0^{s-1}$ | – | – | $L_0^{s-1}$ | $L_0^{s-1}$ |
| 1 | $C_1^{s-1}$ | $Q^{-1}[C_1^{s-1}]$ | $L_0^{s-1}$ | $Lr_1^{s-1} = L_0^{s-1} + Q^{-1}[C_1^{s-1}]$ | $Lr_1^{s-1}$ |
| 2 | $C_2^{s-1}$ | $Q^{-1}[C_2^{s-1}]$ | $Lr_1^{s-1}$ | $Lr_2^{s-1} = L_1^{s-1} + Q^{-1}[C_2^{s-1}]$ | $Lr_2^{s-1}$ |
| 3 | $C_3^{s-1}$ | $Q^{-1}[C_3^{s-1}]$ | $Lr_2^{s-1}$ | $Lr_3^{s-1} = L_2^{s-1} + Q^{-1}[C_3^{s-1}]$ | $Lr_3^{s-1}$ |

FIG. 7

| t | a | b | c | d | e | f | First Delay Portion |
|---|---|---|---|---|---|---|---|
| 0 | $L_0^s = L_0 + L_0^{s-1}$ | – | – | – | – | $L_0^s$ | $L_0^s$ |
| 1 | $L_1^s = L_1 + Lr_1^{s-1}$ | $D_1^s = L_1^s - L_0^s$ | $L_0^s$ | $Q[D_1^s]$ | $C_1^s = Q[D_1^s] + Eq$ | $C_1^s$ | $L_1^s$ |
| 2 | $L_2^s = L_2 + Lr_2^{s-1}$ | $D_2^s = L_2^s - L_1^s$ | $L_1^s$ | $Q[D_2^s]$ | $C_2^s = Q[D_2^s] + Eq$ | $C_2^s$ | $L_2^s$ |
| 3 | $L_3^s = L_3 + Lr_3^{s-1}$ | $D_3^s = L_3^s - L_2^s$ | $L_2^s$ | $Q[D_3^s]$ | $C_3^s = Q[D_3^s] + Eq$ | $C_3^s$ | $L_3^s$ |

FIG. 8

| Frame | Sum1 | Sum2 | Sum2r | diff | Q[diff] | $Q^{-1}$[diff] | Compen | Err |
|---|---|---|---|---|---|---|---|---|
| n | 2000 | 4000 | | | 1 | 1024 | 0 | |
| n+1 | 2100 | 4300 | 3324 | 1224 | 1 | 1024 | 0 | 976 |
| n+2 | 2200 | 4600 | 3424 | 1224 | 1 | 1024 | 0 | 1176 |
| n+3 | 2300 | 4900 | 3524 | 1224 | 1 | 1024 | 0 | 1376 |
| n+4 | 2400 | 5200 | 3624 | 1224 | 1 | 1024 | 0 | 1576 |
| n+5 | 2500 | 5500 | 3724 | 1224 | 1 | 1024 | 0 | 1776 |
| n+6 | 2600 | 5800 | 3824 | 1224 | 1 | 1024 | 0 | 1976 |
| n+7 | 2700 | 6100 | 3924 | 1224 | 1 | 1024 | 0 | 2176 |
| n+8 | 2800 | 6400 | 4024 | 1224 | 1 | 1024 | 0 | 2376 |
| n+9 | 2900 | 6700 | 4124 | 1224 | 1 | 1024 | 0 | 2576 |
| n+10 | 3000 | 7000 | 4224 | 1224 | 1 | 1024 | 0 | 2776 |
| n+11 | 3100 | 7300 | 4324 | 1224 | 1 | 1024 | 0 | 2976 |
| n+12 | 3200 | 7600 | 4424 | 1224 | 1 | 1024 | 0 | 3176 |
| n+13 | 3300 | 7900 | 4524 | 1224 | 1 | 1024 | 0 | 3376 |
| n+14 | 3400 | 8200 | 4624 | 1224 | 1 | 1024 | 0 | 3576 |
| n+15 | 3500 | 8500 | 4724 | 1224 | 1 | 1024 | 0 | 3776 |
| n+16 | 3600 | 8800 | 4824 | 1224 | 1 | 1024 | 0 | 3976 |
| n+17 | 3700 | 9100 | 4924 | 1224 | 1 | 1024 | 0 | 4176 |
| n+18 | 3800 | 9400 | 5024 | 1224 | 1 | 1024 | 0 | 4376 |
| n+19 | 3900 | 9700 | 5124 | 1224 | 1 | 1024 | 0 | 4576 |
| n+20 | 4000 | 10000 | 5224 | 1224 | 1 | 1024 | 0 | 4776 |

FIG. 9

| Frame | Sum1 | Sum2 | Sum2r | diff | Q[diff] | $Q^{-1}$[diff] | Compen | Err |
|---|---|---|---|---|---|---|---|---|
| n | 2000 | 4000 | | | 1 | 1024 | 0 | |
| n+1 | 2100 | 4300 | 3324 | 1224 | 2 | 2048 | 1 | 976 |
| n+2 | 2200 | 4600 | 4448 | 2248 | 2 | 2048 | 0 | 152 |
| n+3 | 2300 | 4900 | 4548 | 2248 | 2 | 2048 | 0 | 352 |
| n+4 | 2400 | 5200 | 4648 | 2248 | 2 | 2048 | 0 | 552 |
| n+5 | 2500 | 5500 | 4748 | 2248 | 2 | 2048 | 0 | 752 |
| n+6 | 2600 | 5800 | 4848 | 2248 | 3 | 3072 | 1 | 952 |
| n+7 | 2700 | 6100 | 5972 | 3272 | 3 | 3072 | 0 | 128 |
| n+8 | 2800 | 6400 | 6072 | 3272 | 3 | 3072 | 0 | 328 |
| n+9 | 2900 | 6700 | 6172 | 3272 | 3 | 3072 | 0 | 528 |
| n+10 | 3000 | 7000 | 6272 | 3272 | 3 | 3072 | 0 | 728 |
| n+11 | 3100 | 7300 | 6372 | 3272 | 4 | 4096 | 1 | 928 |
| n+12 | 3200 | 7600 | 7496 | 4296 | 4 | 4096 | 0 | 104 |
| n+13 | 3300 | 7900 | 7596 | 4296 | 4 | 4096 | 0 | 304 |
| n+14 | 3400 | 8200 | 7696 | 4296 | 4 | 4096 | 0 | 504 |
| n+15 | 3500 | 8500 | 7796 | 4296 | 4 | 4096 | 0 | 704 |
| n+16 | 3600 | 8800 | 7896 | 4296 | 5 | 5120 | 1 | 904 |
| n+17 | 3700 | 9100 | 9020 | 5320 | 5 | 5120 | 0 | 80 |
| n+18 | 3800 | 9400 | 9120 | 5320 | 5 | 5120 | 0 | 280 |
| n+19 | 3900 | 9700 | 9220 | 5320 | 5 | 5120 | 0 | 480 |
| n+20 | 4000 | 10000 | 9320 | 5320 | 5 | 5120 | 0 | 680 |

RECORDING DEVICE AND RECORDING METHOD USING THE SAME

CROSS-REFERENCE TO RELATED APPLICATION

Japanese Patent Application No. 2013-231699, filed on Nov. 8, 2013, in the Japanese Patent Office, and entitled: "Recording Device and Recording Method Using the Same," is incorporated by reference herein in its entirety.

BACKGROUND

1. Field

Embodiments are directed to a technique of suppressing burn-in of an emissive element.

2. Description of the Related Art

A burn-in phenomenon arises in displays using an emissive element, such as organic light emitting diode (OLED). For example, if the same image is continuously displayed, deterioration in a pixel displaying an image with a relatively higher luminance is greater than that in a pixel displaying an image with relatively lower luminance, thereby generating a visible afterimage. This phenomenon is called "burn-in".

To prevent burn-in, light-emitting luminance of each pixel is corrected by calculating a correction coefficient based on totalizing of luminance values of pixels. Now that display devices are used for decades, a memory capacity of about 40 through 50 bits is required for every pixel to add luminance values of all pixels over the period of use. Therefore, a mass storage device and a transfer path with a wide bandwidth capable of transferring mass data are needed due to the large number of all pixels of the display device.

To solve the above-described problem, a variety of methods are used, including the following: reducing of the size of totalizing from a pixel unit to a block unit including 4-by-4 pixels, performing totalizing every several frames, and reducing a capacity by quantization. When only a linear portion of data is compressed, quantization steps are uniform. Hence, resolution on small amplitude of a corresponding signal becomes worse when a signal with a great dynamic range is quantized.

When non-linear quantization is used, i.e., where a great quantization step is applied to great amplitude and a small quantization step is applied to small amplitude, a constant signal-to-noise ratio is obtained regardless of the amplitude size, but a quantization error becomes greater when the amplitude is great. Currently, to decrease the quantization error requires orthogonal conversion and extra transfer bandwidth and memory capacity.

SUMMARY

One or more embodiments is directed to provide a recording device including a subtractor that outputs a difference value between a target totalizing value, obtained by summing a luminance value of a target pixel up to a current frame, and a reference totalizing value corresponding to a luminance value of a reference pixel, adjacent the target pixel, accumulated up to the current frame; a quantizer that quantizes the difference value and outputs a quantization value; and a quantization error corrector that corrects the quantization value at a correction frame that is selected based on a quantization step of the quantization value and a quantization error of the quantization value.

In exemplary embodiments, the reference pixel is a pixel, arranged at an i-th column, from among pixels of a display device arranged in a matrix, and wherein the target pixel is a pixel, arranged at an $i+1^{st}$ column, from among the pixels of the display device.

In exemplary embodiments, the reference pixel and the target pixel belong to the same row.

In exemplary embodiments, the correction frame is selected every K frames (K being a natural number).

In exemplary embodiments, the value of K is decided by dividing the quantization step by the quantization error.

In exemplary embodiments, the quantization error corrector adds a predetermined value to the quantization value in the every correction frame.

In exemplary embodiments, the recording device further comprises a first delay that delays the reference totalizing value, and the subtractor receives the reference totalizing value from the first delay portion.

In exemplary embodiments, the device further includes a first multiplexer that receives the target totalizing value and the quantization value and outputs, as a current recorded value, the target totalizing value when the target pixel is a leading pixel and the quantization value when the target pixel is not the leading pixel, and the leading pixel is a first pixel, belonging to each row, from among pixels of a display device arranged in a matrix.

In exemplary embodiments, the device further includes a memory that stores the current recorded value provided from the first multiplexer.

In exemplary embodiments, the device further includes a de-quantizater that is provided with a previous recorded value of a previous frame corresponding to the target pixel from the memory and de-quantizes the previous recorded value; a second delay that delays a previous recorded value of a previous frame corresponding to the reference pixel; a first adder that adds the previous recorded values of the reference and target pixels and outputs an addition recorded value; and a second multiplexer that receives the previous recorded value of the target pixel and the addition recorded value and outputs, as a previous totalizing value, the previous recorded value of the target pixel when the target pixel is the leading pixel and the addition recorded value of the target pixel when the target pixel is not the leading pixel.

In exemplary embodiments, the device further includes a second adder that adds a current luminance value of the target pixel and the previous totalizing value, and outputs the target totalizing value.

In exemplary embodiments, the quantization portion performs non-linear quantization on the difference value.

A method according to one or more embodiments includes outputting a difference value between a target totalizing value, obtained by summing a luminance value of a target pixel up to a current frame, and a reference totalizing value corresponding to a luminance value of a reference pixel, adjacent the target pixel, accumulated up to the current frame; quantizing the difference value and outputs a quantization value; and correcting the quantization value at a correction frame that is selected based on a quantization step of the quantization value and a quantization error of the quantization value.

BRIEF DESCRIPTION OF THE DRAWINGS

Features will become apparent to those of ordinary skill in the art by describing in detail exemplary embodiments with reference to the attached drawings in which:

FIG. 6 illustrates a diagram showing a variation in a value on each signal path of a read unit, according to an embodiment;

FIG. 7 illustrates a diagram showing a variation in a value on each signal path of a recording unit, according to an embodiment;

FIG. 8 illustrates a diagram describing a quantization error when a quantization error is not corrected by a quantization error correction portion shown in FIG. 3;

FIG. 9 illustrates a diagram describing a quantization error when a quantization error is corrected by a quantization error correction portion shown in FIG. 3.

DETAILED DESCRIPTION

Figure 1:
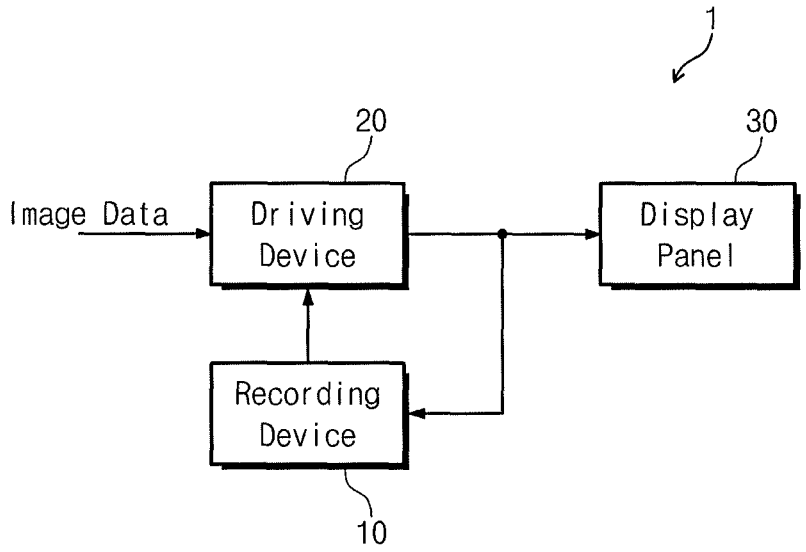
FIG. 1 illustrates a block diagram schematically a display device according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Accordingly, known processes, elements, and techniques are not described with respect to some of the embodiments. Unless otherwise noted, like reference numerals denote like elements throughout the attached drawings and written description, and thus descriptions will not be repeated.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Below, a display device according to an embodiment will be more fully described with reference to accompanying drawings.

FIG. 1 illustrates a block diagram schematically of a display device 1 according to an embodiment. The display device 1 may be a stand alone device or may be part of another device, e.g., a smart phone, a handheld telephone, a personal computer, a television, and so forth. The display device 1 is a device that displays images. The display device 1 may include a recording device 10, a driving device 20, and a display panel 30. The display panel 30 has pixels arranged in a matrix, and each pixel includes a display element for displaying an image. In exemplary embodiments, the display element may be an emissive element (e.g., OLED element).

Figure 2:
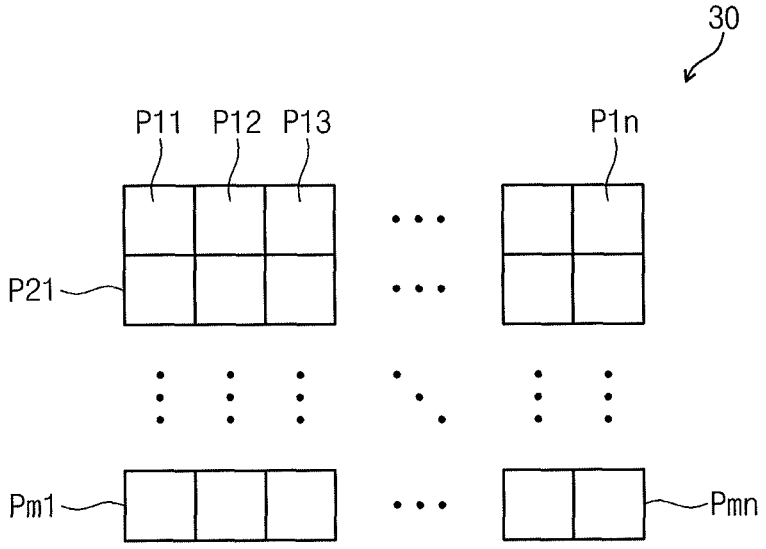
FIG. 2 illustrates a diagram schematically arrangement of pixels of a display panel, according to an embodiment.

FIG. 2 is a diagram schematically illustrating arrangement of pixels of a display panel, according to an embodiment. In exemplary embodiments, a display panel 30 includes pixels arranged in an m-by-n matrix. Below, a pixel at the m-th row and n-th column is denoted by 'Pmn' as illustrated in FIG. 2. For example, first pixels in rows are respectively denoted by 'P11', 'P21', 'P31' . . . 'Pm1'.

Returning to FIG. 1, the driving device 20 drives the display panel 30 based on input image data. In detail, images are displayed by driving each pixel of the display panel 30 through the driving device 20 and making a display element of each pixel emit light based on a luminance value of each pixel. The driving device 20 corrects a luminance value of each pixel included in image data depending on information recorded in the recording device 10 and drives the display panel 30 depending on a luminance value after correction (hereinafter, referred to as a correction luminance value). For example, when a cumulative value of a luminance value of any one pixel is great, e.g., greater than a predetermined amount, indicates that an OLED element of the pixel is being deteriorated. Even though pixels have the same luminance value, a pixel with a great totalizing value, e.g., greater than a predetermined amount, is driven to emit light with a luminance value higher than a pixel with a small totalizing value, e.g., less than the predetermined amount. Thus, correction is made such that a pixel with a great totalizing value displays an image with the same luminance as a pixel with a small totalizing value A correction luminance value of each pixel is provided to the recording device 10, and totalizing information indicating a cumulative correction luminance value for every pixel is recorded in the recording device 10. The totalizing information may include totalizing value (hereinafter, referred to as a reference totalizing value) calculated with respect to a first pixel in each row and a totalizing value (hereinafter, referred to as a differential totalizing value) calculated with respect to other pixels (hereinafter, referred to as succeeding pixels in each row). The reference totalizing value and the differential totalizing value may indicate a totalizing value corresponding to each pixel in different forms.

The reference totalizing value is a totalizing value on a correction luminance value of a pixel to be calculated (e.g., a first pixel in each row). First pixels in rows may be most leftmost pixels in the rows as illustrated in FIG. 2. The differential totalizing value is a value (hereinafter, referred to as a quantization value) obtained by quantizing a difference between a totalizing value, obtained by adding correction luminance values of succeeding pixels in each row, and a totalizing value of a previous pixel. In exemplary embodiments, a previous pixel of a target pixel when calculating a totalizing value may mean a pixel that receives data immediately before an input of data corresponding to the target pixel. In FIG. 2, the previous pixel may be a pixel adjacent to the left of the target pixel. For example, a previous pixel of a pixel P13 is a pixel P12.

As described above, the recording device 10 uses a differential totalizing value, rather than a totalizing value, corresponding to a pixel adjacent to the left in a row direction of the target pixel is recorded with respect to succeeding pixels in each pixel. If a totalizing value is used instead of a differential totalizing value numerous bits, e.g., 40 through 50 bits may be needed to record the totalizing value. However, less capacity is needed to record the differential totalizing value. In particular, using a differential totalizing value is effective in an area where a variation in luminance between adjacent pixels is small.

Meanwhile, non-linear quantization is used when a variation in a totalizing value is great, e.g., when a difference in luminance between images displayed through adjacent pixels is great, i.e., greater than a predetermined value, and different states are continuous. The reason is that a dynamic range of the difference value is great. In the non-linear quantization, a non-ignorable, e.g., noticeable, quantization error may occur when a quantization step varies with the amplitude and a difference value among amplitudes is great.

Since a totalizing value corresponding to each pixel indicates a sum of luminance values, a difference between totalizing values that is great, e.g., greater than a predetermined amount, means that a difference in luminance among images displayed through any adjacent pixels has a common value continues to occur. In other words, an image where adjacent pixels have a common value is displayed with high probability, and probability that such an image is continuously displayed later is high. For example, even though no common luminance difference currently occurs between adjacent pixels, that a common luminance difference continuously occurs later is postulated in compliance with the trend that a difference in a totalizing value is great. Thus, as a quantization error of the non-linear quantization becomes greater, probability that a difference in a totalizing value continuously increases becomes higher. This means that it is necessary to correct a quantization error along a time axis. A difference in a totalizing value is expressed by a less number with a relatively less quantization error, by correcting the quantization error as described above. Below, a configuration of the recording device 10 will be more fully described.

Figure 3:
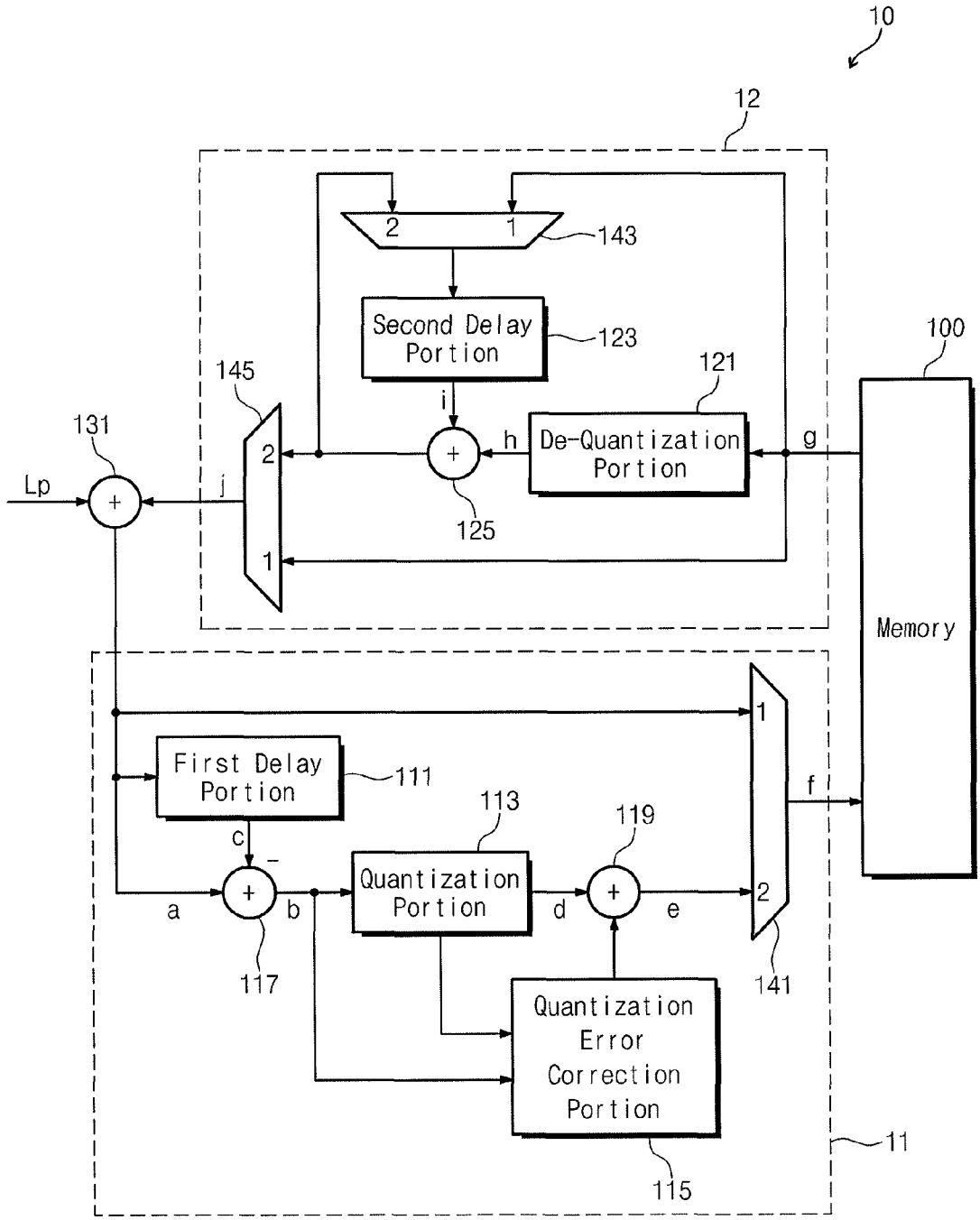
FIG. 3 illustrates a block diagram schematically a recording device according to an embodiment.

FIG. 3 is a block diagram schematically illustrating the recording device 10 according to an embodiment. The recording device 10 may include a recording unit 11 to record totalizing information in a memory 100 and a read unit 12 to read totalizing information from the memory 100. The recording unit 11 and the read unit 12 are connected to an adder 131. The adder 131 adds a luminance value Lp of a target pixel and a value (j) from the read unit 12, and outputs the totalizing result (a) (a target totalizing value) to the recording unit 11. The luminance value Lp may be a luminance value of the target pixel that is received at a current frame. The value (j) may be a luminance value added up to a previous frame of the target pixel.

The recording unit 11 may include a first delay portion 111, a quantization portion 113, a quantization error correction portion 115, a subtraction portion 117, an addition portion 119, and a multiplexer 141. The first delay portion 111 delays the value (a) as long as a period corresponding to the amount of data, corresponding to one pixel, from among input image data, and outputs a value (c) (a reference totalizing value) as the delay result. The subtraction portion 117 subtracts the value (c) from the input value (a) and outputs a value (b) as the subtraction result. That is, the value (b) is a difference value between the values (a) and (c).

The quantization portion 113 performs non-linear quantization on the value (b) and outputs a value (d) as the non-linear quantization result. In exemplary embodiments, the quantization portion 113 may perform non-linear quantization on a difference between cumulative values to obtain appropriate resolution even though a difference value has a relatively small amplitude. In general, the Logarithmic (Log) function is frequently used as a non-linear quantization model, but the quantization portion 113 may perform quantization by means of the broken-line approximation based on the Log function or the function approximation.

If a width of a difference value (the value (b)) is referred to as 'n' and a width after quantization is referred to as 'm', the base 'x' of the Log function corresponding to the following equation (1) is expressed by the following equation (2).

$$\log_x^{2^m} = 2^n \tag{1}$$

$$x = 2^{\frac{m}{2^n}} \tag{2}$$

The quantization error correction portion 115 obtains the value (b) from the subtraction portion 117, the value (d) from the quantization portion 113, and a quantization step when quantization is made to obtain the value (d). The quantization error correction portion 115 calculates a quantization error from a difference between the value (b) and a value quantized to obtain the value (d), and obtains a result K (K being a natural number), obtained by dividing the quantization step by the quantization error for every pixel. The quantization error correction portion 115 selects a correction frame based on the calculation result K and directs correction on the quantization value (d) every correction frame. In particular, the quantization error correction portion 115 provides '0' to the addition portion 119 with respect to a frame for which no correction is needed for every pixel, and provides '1' to the addition portion 119 with respect to a correction frame for which correction is needed for every pixel. In an implementation, '1' is added every K frames on average. Therefore, '2' is added every 2K frames.

If the quantization error becomes great, as described above, probability that a luminance difference between images displayed through adjacent pixels supplied with a common value occurs is high. Thus, the quantization error accumulated with the lapse of time is reduced by adding '1' to a quantization value on the difference as described above. The amount of correction on the quantization error may be approximately estimated from a difference in a totalizing value among luminance values of a current frame and a quantization step, which will be more fully described later.

Also, even though the calculation result K is variable every frame, a reciprocal 1/K of the calculation result K is added every frame, correction is made every frame where a totalizing value of 1/K exceeds a predetermined value (e.g., '1'), and the totalizing value is reset. Also, an embodiment is exemplified as the quantization error correction portion 115 obtains the calculation result K every pixel. However, embodiments are not limited thereto. For example, one calculation result K may be obtained from a plurality of pixels, and may be used in common with respect to the plurality of pixels.

The addition portion 119 adds a correction value Eq from the quantization error correction portion 115 (e.g., '1' when correction or '0' when no correction) to the value (d) and outputs a value (e) as the addition result. The multiplexer 141 selects and outputs an input (1) when the target pixel is a first pixel in each row and an input (2) when the target pixel is a succeeding pixel in each row, and an output of the multiplexer 141 is recorded at the memory 100 as a totalizing value (f) of the target pixel. That is, the value (f) (a current recorded value) to be recorded may be the value (a) (a target totalizing value of the target pixel) or the value (e) (a differential totalizing value of the target pixel). As described above, the differential totalizing value (e) may be the value (d) quantized by the quantization portion 113 or a value obtained by correcting the value (d) by the quantization error correction portion 115.

Below, the read unit 12 will be described. The read unit 12 may include a de-quantization portion 121, a second delay portion 123, an addition portion 125, and multiplexers 143 and 145.

The de-quantization portion 121 de-quantizes a value (g) (a differential totalizing value of the target pixel or previously recorded value) read from the memory 100 and outputs a value (h) as the de-quantization result. The de-quantization portion 121 makes de-quantization by means of algorithm that is used in quantization in the quantization portion 113.

The second delay portion 123 delays a value from the multiplexer 143 (corresponding to the value (j)) (e.g., a value (g) or a value of (h+i)) as long as a period corresponding to the amount of data, corresponding to one pixel, from among input image data and outputs a value (i) as the delay result. The addition portion 125 adds the values (h) and (i) to output an added recorded value (h+i).

Like the multiplexer 141, the multiplexers 143 and 145 output inputs (1) (the value (g)) when the target pixel is a first pixel in each row and inputs (2) (the value of (h+i)) when the target pixel is a succeeding pixel in each row. A value output from the multiplexer 145 may be the value (j) (a previous totalizing value) provided to the addition portion 131 as described above. In particular, when the target pixel is the leading pixel, e.g., a leftmost pixel in a row, the value (j) is the previous recorded value (g) of the target pixel and, when the target pixel is not the leading pixel, the value (j) is the added recorded value (h+i).

Figure 4:
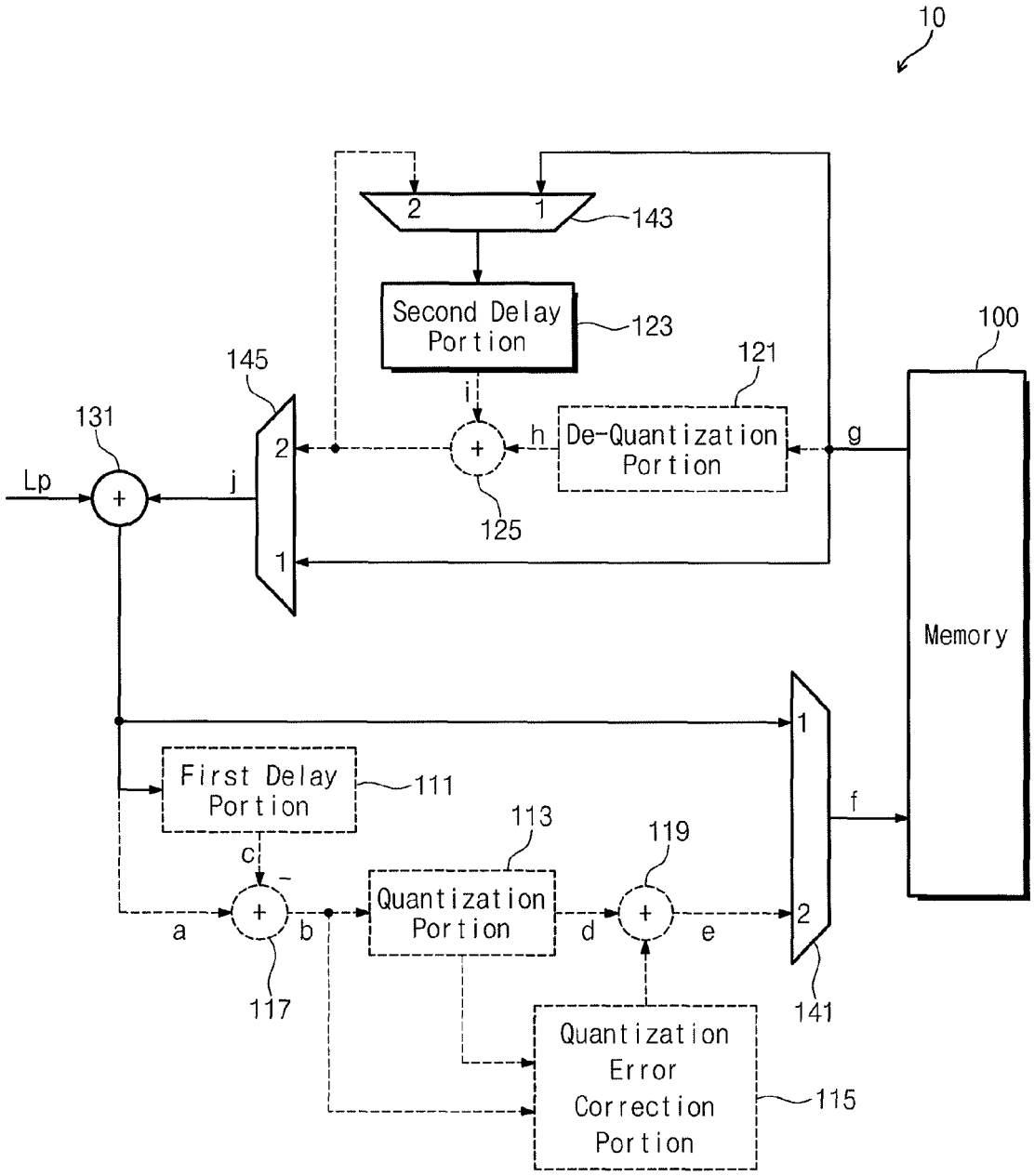
FIG. 4 illustrates a first operation block diagram describing an operation of a recording device on a first pixel in each row.
Figure 5:
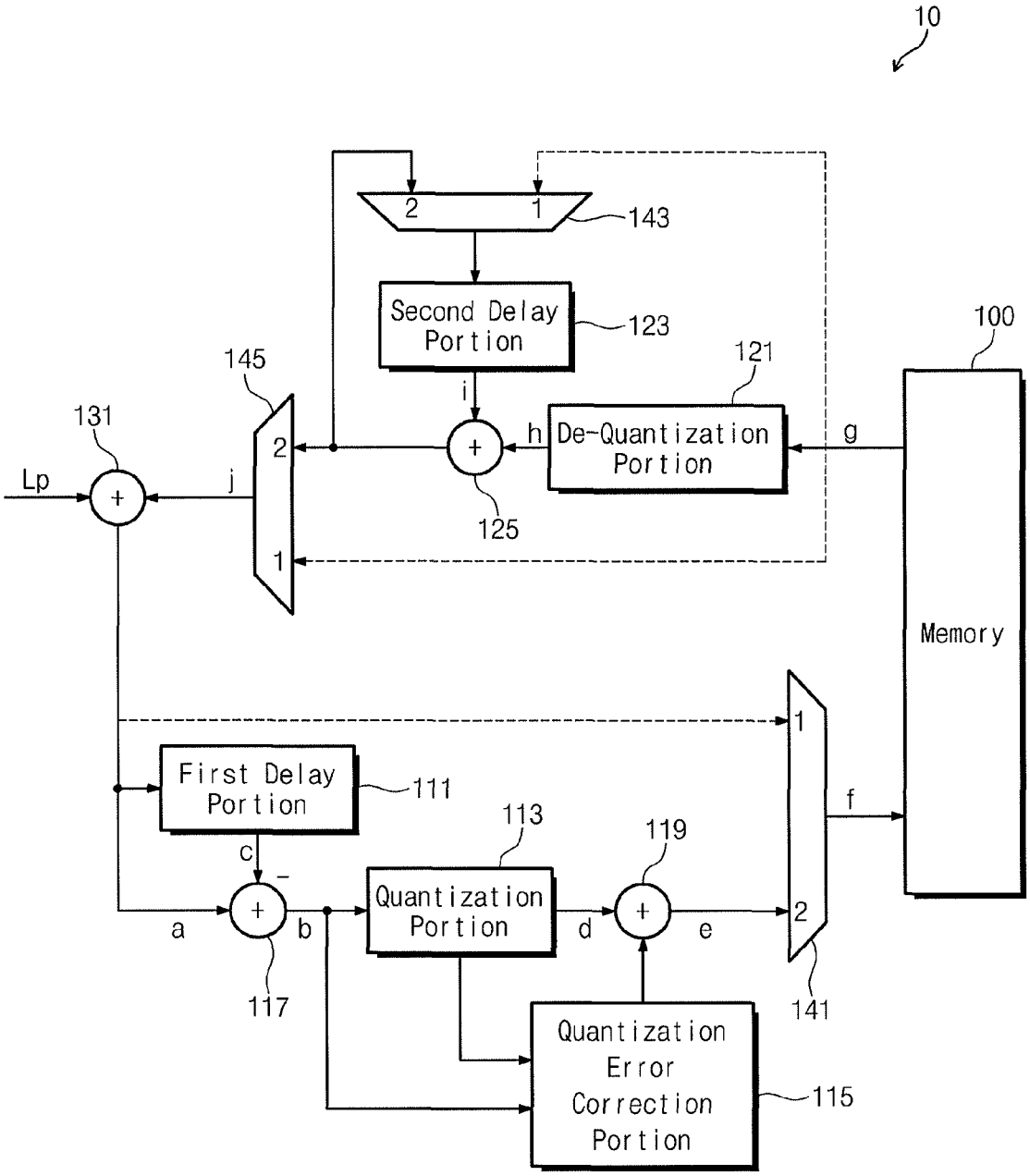
FIG. 5 illustrates a second operation block diagram describing an operation of a recording device on a succeeding pixel in each row.

FIG. 4 illustrates a first operation block diagram for describing an operation of a recording device on a first pixel in each row. FIG. 5 is illustrates second operation block diagram for describing an operation of a recording device on a succeeding pixel in each row.

A first operation of a recording device 10 shown in FIG. 4 is an operation when a target pixel is a leading pixel, e.g., a first pixel, e.g., a leftmost pixel, in each row. Inputs (1) of multiplexers 141, 143, and 145 are selected during the first operation. A second operation of the recording device 10 shown in FIG. 5 is an operation when the target pixel is not the leading pixel, e.g., a succeeding pixel in each row. Inputs (2) of multiplexers 141, 143, and 145 are selected during the second operation. In FIGS. 4 and 5, a solid line indicates components that operate, and a dotted line indicates components that don't operate.

A variation in a value on each signal path will be described as an operation of the recording device 10. FIG. 6 is a diagram showing a variation in a value on each signal path of the read unit 12, according to an embodiment. FIG. 7 is a diagram showing a variation in a value on each signal path of the recording unit 10, according to an embodiment.

't' indicates the lapse of time and indicates a period where a luminance value of a $t+1^{st}$ pixel is provided to the recording device 10. Thus, when t='0', a luminance value provided to the recording device 10 corresponds to a luminance value of a first pixel (e.g., P11) of each row. When t='1', a luminance value provided to the recording device 10 corresponds to a luminance value of a second pixel (e.g., P12). An embodiment is exemplified as time varies from 0 to 3, for ease of explanation.

In FIGS. 6 and 7, an embodiment is exemplified as a luminance value of a pixel of an s-th frame is received. Thus, the read unit 12 may read information that is recorded at a memory 100 until an $s-1^{st}$ frame being a previous frame with respect to each value. Each parameter in FIGS. 6 and 7 is defined as follow.

'$L_t^s$': a totalizing value corresponding to a $t+1^{st}$ pixel until an s-th frame.

'$Lr_t^s$': a value obtained by adding a totalizing value ($L_{t-1}^s$) corresponding to a t-th pixel until an s-th frame to a totalizing value ($Q^{-1}[C_t^s]$) corresponding to a $t+1^{st}$ pixel until the s-th frame is calculated through quantization/de-quantization.

The value $Lr_t^s$ may be information for correcting a luminance value ($s+1^{st}$ frame) of a $t+1^{st}$ pixel when the driving device 20 drives the display panel 30.

'$L_t$': a luminance value (corresponding to Lp) of a $t+1^{st}$ pixel of the s-th frame.

'$L_t^s$': a difference between a totalizing value $L_{t-1}^s$ corresponding to a t-th frame of the s-th frame and a totalizing value $L_t^s$, corresponding to a $t+1^{st}$ pixel.

'$C_t^s$': a value obtained by adding an error correction value Eq (a value from an quantization error correction portion 115) to a quantization value $Q[L_t^s]$ of $D_t^s$.

An effect of the recording device 10 obtained by correcting a quantization error will be described with reference to embodiments.

FIG. 8 is a diagram describing a quantization error when a quantization error is not corrected by a quantization error correction portion shown in FIG. 3. FIG. 9 is a diagram describing a quantization error when a quantization error is corrected by a quantization error correction portion shown in FIG. 3. FIGS. 8 and 9 show a variation of each parameter from a frame (n) to a frame (n+20) with respect to totalizing values of pixels P11 and P12. In exemplary embodiments, it is assumed that a luminance value of the pixel P11 is '100' and a luminance value of the pixel P12 is '300'. When this assumption is continuously applied, each parameter in FIGS. 8 and 9 is defined as follows.

'Sum1': a totalizing value of a luminance value of the pixel P11 (corresponding to $L_0^s$ and assumed that a totalizing value until an n-th frame is '2000').

'Sum2': an ideal totalizing value of a luminance value of the pixel P12 (assumed that a totalizing value until an n-th frame is '4000').

'Sum2r': a value obtained by adding a luminance value (300) of the pixel P12 to a totalizing value (corresponding to $L_1^{s-1}$, totalized until previous frame) corresponding to pixel P12 obtained by adding $Q^{-1}$[diff] of a previous frame (a value obtained by de-quantizing a differential totalizing value recorded in the memory 100) to 'Sum1' of the previous frame.

'diff': a value (corresponding to $D_1^s$) obtained by subtracting 'Sum1' from 'Sum2r'.

'Q[diff]': a value obtained by quantizing 'diff' (as an example, a quantization step is '1024').

'$Q^{-1}$[diff]': a value obtained by de-quantizing 'Q[diff]'.

'Compen': a value (corresponding to a correction value Eq) output from the quantization error correction portion 115.

'Err': a value indicating an error between a value (i.e., an ideal value), obtained by subtracting 'Sum2r' from 'Sum2', and a recorded totalizing value. In other words, a value of 'Err' is added every frame as much as a value (e.g., a quantization error of each frame) obtained by subtracting $Q^{-1}$[diff]' from 'diff'.

In FIG. 8, 'Compen' is 0. However, in FIG. 9, 'Compen' becomes ' 1' every five frames. In this particular example, correction is made every five frames, since a quantization error of each frame is 200 (=1224−1024), a quantization step is '1024', and 5.12=1024/200.

Figure 10:
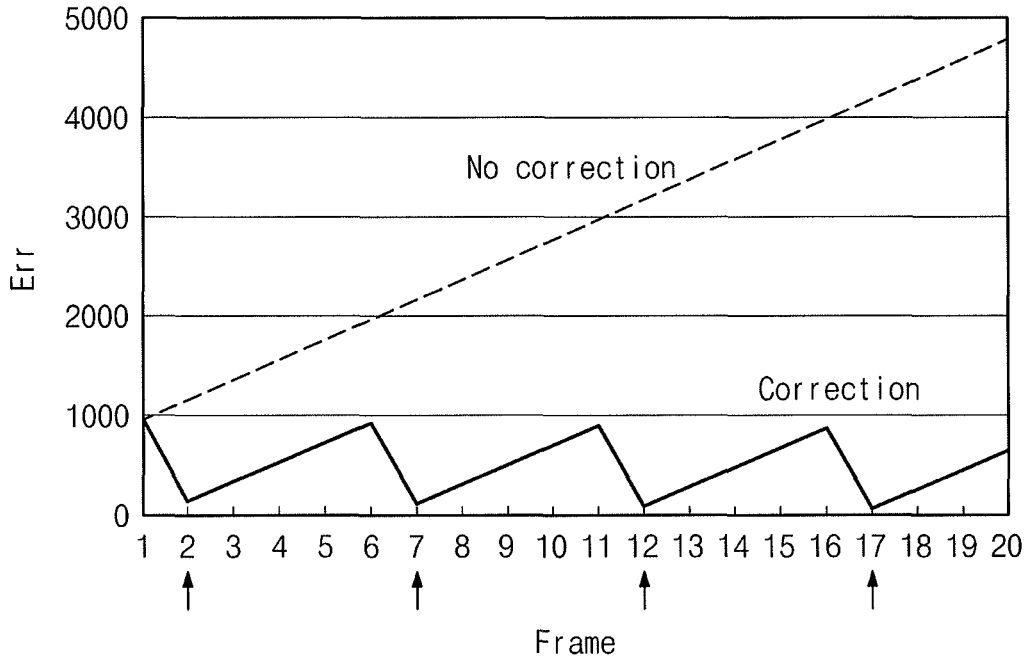
FIG. 10 illustrates a diagram comparing time variations of a quantization error when a quantization error is corrected and when a quantization error is not corrected.

FIG. 10 is a diagram comparing time variations of a quantization error when a quantization error is corrected and when a quantization error is not corrected. As illustrated in FIG. 10, when a quantization error is not corrected, a quantization error is accumulated with the lapse of time, thereby causing an increase in an error. Meanwhile, when a quantization error is corrected every predetermined time with the lapse of time (a frame marked by an arrow of FIG. 10), a quantization error is reduced. Thus, the quantization error is restricted below a constant level (e.g., a range of the quantization step).

As described above, when a luminance value of each pixel is added, a totalizing value from frames up until a previous frame is read from the memory 100, a luminance value of a current frame is added to this totalizing value, and a new totalizing value is again written at the memory 100. A totalizing value corresponding to a leading pixel, e.g., first pixel, e.g., leftmost pixel, of each row, is recorded at the memory 100 without modification. Meanwhile, a totalizing value on a succeeding pixel of each pixel is not transferred to the memory 100 for recording, but a differential totalizing value, which is obtained by quantizing a difference with a totalizing value corresponding to a pixel adjacent in a horizontal direction of the totalizing value, is recorded at the memory 100, thus reducing overall memory requirements.

In an error due to quantization, it is possible to prevent a quantization error from continuously increasing by correcting a quantization error of a differential totalizing value with the lapse of time by means of a quantization step and a value decided depending on the quantization error. As described above, since a quantization error continues to increase when an image where the same luminance difference is continuous among adjacent pixels is displayed, the quantization error is reduced through the above-described correction method.

In exemplary embodiments, even though a totalizing value of a luminance value is recorded at each pixel, implement is possible with a relatively less memory capacity. Also, correction may be made at an actual frame rate. For example, it is assumed that a luminance value of a full-HD-class pixel is added for decades. With this assumption, conventionally, 48 bits are needed to retain a totalizing value of each pixel, and a 95M-bit memory is needed to store totalizing values of all pixels when the totalizing values are not quantized. In this case, a conventional display device may include a 128M-bit memory device, for example.

Meanwhile, in the even that a differential totalizing value concept is quantized and a quantization error is corrected, for example, 16 bits are needed to retain a totalizing value of each pixel, and a 32M-bit or less memory is needed to store totalizing values of all pixels. In this case, a display device may include a 32M-bit memory device, for example.

Thus, one or more embodiments may reduce a memory capacity needed and a quantization error at recording of a totalizing value of luminance values of pixels using non-linear quantization based on a differential quantizing value.

The methods and processes described herein may be performed by code or instructions to be executed by a computer, processor, manager, or controller. Because the algorithms that form the basis of the methods (or operations of the computer, processor, or controller) are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A device, comprising:

a subtractor that outputs a difference value between a target totalizing value, obtained by summing a luminance value of a target pixel in a current frame and luminance values of the target pixel in previous frames, and a reference totalizing value, obtained by summing a luminance value of a reference pixel in the current frame and luminance values of the reference pixel in the previous frames, the reference pixel being adjacent the target pixel;

a quantizer that quantizes the difference value and outputs a quantization value using a quantization method having a quantization step and a quantization error; and a quantization error corrector that corrects the quantization value at a correction frame based on the quantization step and the quantization error, wherein the quantization step is number of levels used in the quantization method.

2. The device as claimed in claim 1, wherein the reference pixel is a pixel, arranged at an i-th column, from among pixels of a display device arranged in a matrix, wherein i is a positive integer, and wherein the target pixel is a pixel, arranged at an $i+1^{st}$ column, from among the pixels of the display device.

3. The device as claimed in claim 2, wherein the reference pixel and the target pixel belong to the same row.

4. The device as claimed in claim 3, wherein the correction frame is selected every K frames, wherein K is a positive integer.

5. The device as claimed in claim 4, wherein the value of K is determined by dividing the quantization step by the quantization error.

6. The device as claimed in claim 4, wherein the quantization error corrector adds a predetermined value to the quantization value in every correction frame.

7. The device as claimed in claim 4, further comprising:

a first delay that delays the reference totalizing value, wherein the subtractor receives the reference totalizing value from the first delay.

8. The device as claimed in claim 7, further comprising:

a first multiplexer that receives the target totalizing value and the quantization value and outputs, as a current recorded value, the target totalizing value when the target pixel is a leading pixel and the quantization value when the target pixel is not the leading pixel, and wherein the leading pixel is a first pixel, belonging to each row, from among pixels of a display device arranged in a matrix.

9. The device as claimed in claim 8, further comprising:

a memory that stores the current recorded value provided from the first multiplexer.

10. The device as claimed in claim 9, further comprising:

a de-quantizer that receives a previous recorded value of the target pixel in a previous frame from the memory and de-quantizes the previous recorded value;

a second delay that delays a previous recorded value of the reference pixel in the previous frame;

a first adder that adds the previous recorded values of the reference pixel and the target pixel in the previous frame, and outputs an addition recorded value; and a second multiplexer that receives the previous recorded value of the target pixel and the addition recorded value, and outputs, as a previous totalizing value, the previous recorded value of the target pixel when the target pixel is the leading pixel and the addition recorded value of the target pixel when the target pixel is not the leading pixel.

11. The device as claimed in claim 10, further comprising:

a second adder that adds a current luminance value of the target pixel and the previous totalizing value to output the target totalizing value.

12. The device as claimed in claim 1, wherein the quantizer performs non-linear quantization on the difference value.

13. A method comprising:

outputting a difference value between a target totalizing value, obtained by accumulating a luminance value of a target pixel in a current frame and luminance values of the target pixel in previous frames, and a reference totalizing value, obtained by summing a luminance value of a reference pixel in the current frame and luminance values of the reference pixel in the previous frames, the reference pixel being adjacent the target pixel;

quantizing the difference value and outputs a quantization value using a quantization method having a quantization step and a quantization error; and correcting the quantization value at a correction frame that is selected based on the quantization step and the quantization error, wherein the quantization step is number of levels used in the quantization method.

* * * * *